US006367139B2

(12) United States Patent
Wille

(10) Patent No.: US 6,367,139 B2
(45) Date of Patent: Apr. 9, 2002

(54) PNEUMATIC-HYDRAULIC BLIND RIVETING DEVICE

(75) Inventor: Lothar Wille, Mörfelden-Walldorf (DE)

(73) Assignee: GESIPA Blindniettechnik GmbH, Frankfurt (DE)

( * ) Notice: Subject to any disclaimer, the term of this patent is extended or adjusted under 35 U.S.C. 154(b) by 0 days.

(21) Appl. No.: 09/798,517

(22) Filed: Mar. 2, 2001

(30) Foreign Application Priority Data

Mar. 10, 2000 (DE) ..... 100 11 340

(51) Int. Cl.[7] ..... B21J 15/20
(52) U.S. Cl. ..... 29/243.525; 29/243.523
(58) Field of Search ..... 29/243.521, 243.523, 29/243.524, 243.525

(56) References Cited

U.S. PATENT DOCUMENTS 4,515,005 A * 5/1985 Klein ..... 72/391
4,580,435 A * 4/1986 Port et al. ..... 72/391
5,598,619 A * 2/1997 Rosier ..... 29/243.523

FOREIGN PATENT DOCUMENTS

| | | |
|---|---|---|
| DE | 3153057 | 5/1985 |
| EP | 0062206 | 10/1982 |
| EP | 0927586 | 7/1999 |

* cited by examiner

*Primary Examiner*—David Jones
(74) *Attorney, Agent, or Firm*—Friedrich Kueffner

(57) ABSTRACT

A pneumatic-hydraulic blind riveting device has a device housing and a pulling device arranged in the device housing. The pulling device has a chuck housing and chuck jaws arranged in the chuck housing. The pulling device has a pulling piston connected to the chuck housing and also has a return piston. The pulling device has a pressure bushing arrangement resting against the chuck jaws and interacting with the return piston. A pressure chamber is defined between the return piston and the pulling piston. A control device is designed to load the pressure chamber with a controlled pressure.

12 Claims, 3 Drawing Sheets

PNEUMATIC-HYDRAULIC BLIND RIVETING DEVICE

BACKGROUND OF THE INVENTION

1. Field of the Invention

The invention relates to a pneumatic-hydraulic blind riveting device with a pulling device arranged in a device housing and comprising a chuck housing that is connected with a hydraulic pulling piston and surrounds chuck jaws against which a pressure bushing arrangement rests which cooperates with a return piston.

2. Description of the Related Art

Such a blind riveting device is known from German patent DE 31 53 057 C2. The energy required for the riveting action of a blind riveting device is provided by means of compressed air which is available in many manufacturing facilities at a standard pressure of 6 bar. This compressed air actuates a pneumatic piston. This pneumatic piston is rigidly connected to a hydraulic piston which has a considerably smaller active surface. The hydraulic piston generates accordingly a relatively high pressure in a hydraulic liquid. This hydraulic liquid acts then onto the pulling piston. The pulling piston has a pulling force-transmitting connection with the chuck housing. The chuck housing has at its inner side a conically extending contact surface for the chuck jaws which rest in a ready position of the riveting device on a mouth and can thus be inserted into the chuck housing so that they open and a riveting drift of a blind rivet can be inserted. The movement of the chuck housing caused by the pulling piston has two effects. On the one hand, the chuck jaws are pressed together radially inwardly when the chuck housing is moved in the pulling direction across the chuck jaws. When the chuck jaws then secure the drift of the rivet, a further pulling movement of the chuck housing causes the chuck jaws to entrain the drift of the rivet so that the drift initially deforms the hollow rivet in a manner known in the art and subsequently is broken off.

After the drift has broken off, the pneumatic cylinder is relieved so that the hydraulic pressure on the pulling piston decreases. Pressure, for example, resulting from compressed air, now acts on the return piston. The return piston moves the pulling piston and thus also the chuck housing again into the initial position. The pressure bushing arrangement comprises for this purpose at its center a pressure spring so that the return piston can move the chuck housing farther by a small distance when the chuck jaws rests against a mouth of the housing. Accordingly, the chuck jaws become free of the chuck housing and can open. The broken-off riveting drift can then be removed or can be sucked out to the rear of the blind riveting device. A new blind rivet can then be inserted with its riveting drift. In the end, during opening of the chuck jaws the spring, which is responsible for the closing force of the chuck jaws onto the riveting drift during the next riveting process of the blind rivet, is pretensioned.

Such an embodiment of a blind riveting device has basically proven successful in practice. However, after riveting a certain number of blind rivets it was found that the chuck jaws no longer are secured with the desired reliability on the riveting drift. Increasingly, the chuck jaws slide on the riveting drift so that the formation of the rivet connection to be formed with the blind rivet no longer provides the desired reliability. This is so increasingly when the teeth of the chuck jaws are already slightly dull as a result of wear. Accordingly, gripping of the riveting drift is no longer possible or is at least made significantly more difficult; this can result in failure of the device. The chuck jaws then have to be replaced.

SUMMARY OF THE INVENTION

It is an object of the present invention to control the riveting process with blind rivets in a reliable fashion.

In accordance with the present invention, this is achieved in that between the return piston and the pulling piston a pressure chamber is arranged which is loadable by means of a control device with a controlled pressure.

With such a configuration it is possible to affect the closing forces acting on the chuck jaws in a more directed way. Primarily, it is possible to effect by means of the controlled pressure an opening of the chuck jaws upon return of the pulling device as well as an application of a closing force which, in general, is greater than the closing force provided by a spring. When the pressure chamber is loaded with pressure, the pulling piston and thus also the chuck housing are moved by the pressure into the front-most position in which the chuck jaws come free of the chuck housing. The chuck jaws, because they rests against the mouth, cannot be moved farther to the front. When however the pressure in the pressure chamber is lowered and at the same time, or at a later point in time, the pulling piston is loaded with hydraulic pressure, the chuck housing-is moved to the rear against the chuck jaws, i.e., away from the mouth, with a force which is as large as the force which secures the return piston in the return piston position. Accordingly, substantially greater forces are transmitted onto the chuck jaws which results in a safe gripping of the riveting drift with a substantially increased service life of the gripping jaws. This primarily reduces the wear of the gripping jaws. At the same time, it can be ensured over a longer period of time that the riveting process for the rivets is carried out with the desired reliability.

Preferably, the pressure bushing arrangement is of a rigid configuration between the return piston and the chuck jaws in the pressure direction. Accordingly, there is no pressure spring arranged between the return piston and the chuck jaws; instead, the return piston can be forced permanently from behind against the chuck jaws. Accordingly, the pressure with which the return piston presses via the pressure bushing arrangement onto the chuck jaws is a measure for the closing force with which the chuck housing can press the chuck jaws together. The closing force, which in the past was supplied by a pressure spring, is thus replaced by a closing force which is controlled by pressures.

Preferably, the pressure bushing arrangement has a pressure bushing which is divided in the transverse direction whose end facing the chuck jaws is embodied as a hollow cylinder with a smooth mantle surface. This part is also a wear member which, if needed, can be easily exchanged. When closing the chuck jaws, there is always a small movement with a corresponding wear at the contact location between the pressure bushing and the chuck jaws because this movement is partially carried out under a relatively high pressure. When now the end of the wear member facing the chuck jaws is formed as an exchangeable part, it is no longer required to exchange the entire pressure bushing arrangement.

Preferably, the control device lowers the pressure in the pressure chamber when it loads the pulling piston in the pulling direction with hydraulic pressure. The change of the two pressures can be carried out simultaneously or at least within a narrow temporal time frame. It is possible in this way to effect the control of the two pressures with a single movement of the hand or finger of the operator. When the pressure in the pressure chamber is lowered, the movement of the pulling piston no longer is counteracted by a direct resistance so that the movement of the pulling piston can be immediately converted into a closing movement with subsequent pulling movement.

Preferably, on both sides of the return piston the same pressure is adjustable, wherein the return piston on a side facing away from the pulling piston has a larger active surface than on a side facing the pulling piston. The adjustment of the same pressures is a relatively simple measure. Required is only a single pressure source. By arranging active surfaces of different sizes at the front side (facing the pulling piston) and the backside of the return piston, it is then possible, also in a very simple way, to apply different forces onto the return piston. These forces are oriented such that the return piston is always loaded in the direction toward the mouth. When the chuck jaws rests against the mouth, only the difference of the two forces acts onto the mouth so that the configuration of the housing must not be excessively greatly dimensioned.

In this connection it is especially preferred that the return piston is connected to a return pipe which projects into a connecting pipe. With the aid of the pulling piston pipe it is now possible in a simple way to reduce the size of the active surface.

Preferably, the side of the return piston facing away from the pulling piston is loaded with a constant pressure. This pressure can be a pressure with which the blind riveting devices operate, for example, compressed air at 6 bar. Since the side of the pulling piston facing away from the return piston must no longer be pressure-controlled, its configuration is very simple. This pressure on the backside of the return piston must only be able to push the pulling device again back into its initial position.

Preferably, the return piston is guided in an ejector pipe. This embodiment has several advantages. On the one hand, on the side of the return piston facing away from the pulling piston a pressure chamber can be formed which is closed to the exterior and at the same time provides a disposal path for broken-off riveting drifts. On the other hand, with an additional guiding of the return piston it is ensured that lateral movements of the return piston are substantially completely excluded so that sealing problems are minimized. It is possible with simple measures to seal the return piston relative to the housing.

In this respect, it is particularly preferred that the ejector pipe comprises a lock which can be actuated by the riveting drift collecting container. The lock has a lock surface which is matched such to the cross-section of the ejector pipe that a gap remains which allows an effective flowing of air but prevents ejection of the blind riveting drifts. This lock is a safety feature. In many blind riveting devices, the broken-off riveting drifts are removed by vacuum or by means of compressed air and are collected in a collecting container. A collecting container not only collects the riveting drifts over a certain period of time. It also prevents that operating personnel is endangered by riveting drifts which, in the truest sense of the word, can be shot out of the pulling mechanism during vacuuming of the device. It is possible to prevent that the riveting drifts are shot out to the rear from the ejector pipe by simply closing off the ejector pipe. However, in this situation, a pressure is generated which in the end leads to the riveting drifts to be shot out toward the front, i.e., through the mouth. These two possibilities are excluded when the lock is now configured such that the air can flow out but the gap between lock and ejector pipe is so small that the riveting drifts can no longer pass through the opening. The riveting drifts remain thus in the ejector pipe as long as the lock is in its locking position. Such a situation occurs, for example, when the operator has removed the collecting container in order to empty it.

In this connection, it is particularly preferred to form the lock by a finger on a plate which is pivotable about an axis which extends parallel to the axis of the ejector pipe. This considerably reduces the construction length of the device. The lock requires practically no space in the axial or pulling direction but can close off reliably the path extending through the ejector pipet This is true in particular when the finger can be inserted substantially radially into the ejector pipe. In this case, the movement of the lock requires practically no additional construction space.

Preferably, the chuck jaws are guided in the chuck housing in grooves whose groove bottoms have a constant cross-section across a predetermined length, wherein the chuck jaws are matched to their cross-section, respectively. In this case, the chuck jaws are secured in the chuck housing always by a defined pressing surface, independent of the axial position, i.e., the position in the direction of pulling. With this measure, the surface pressing onto the chuck jaws can be maintained identical independent of the position of the chuck jaws. Impermissibly high pressing forces are thus prevented.

DESCRIPTION OF THE PREFERRED EMBODIMENTS

Figure 1:
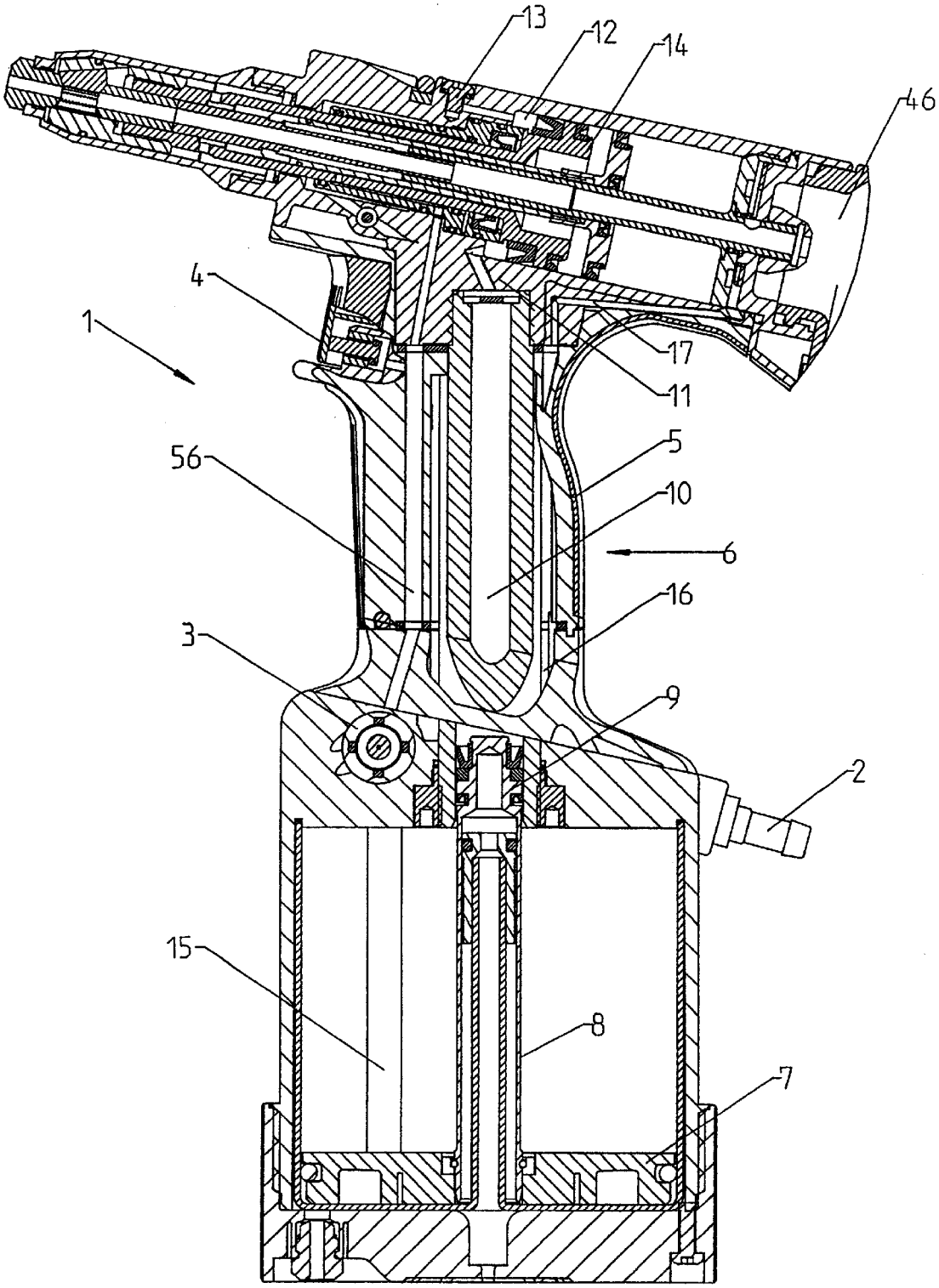
FIG. 1 is a schematic sectional view of a blind riveting device.

FIG. 1 shows a pneumatic-hydraulic blind riveting device 1 with a compressed air connector 2 via which compressed air is supplied to the blind riveting device 1 at a pressure of, for example, 6 bar. A sliding valve 3, known in the art, controls the supply of compressed air to the individual components of the blind riveting device 1, in particular, under the effect of a push-button switch or pressure switch 4 which is arranged in the grip area 5 on the grip 6 of the blind riveting device 1 such that it can be actuated, for example, by the index finger of an operator.

The basic function of such a blind riveting device is known. When the push-button switch 4 is suppressed, the sliding valve 3 is controlled such that the compressed air is guided to a location underneath a pneumatic piston 7 and moves it in the upward direction (relative to the illustration of FIG. 1). By means of a piston rod 8 a hydraulic piston 9 is rigidly connected with the pneumatic piston 7 and, upon movement of the pneumatic piston 7, is also moved in the upward direction and thus pressurizes the hydraulic liquid in a hydraulic cylinder 10 and conveys it via a channel 11 into a working chamber 12. The working chamber 12 is fillable via a closure plug 13 with hydraulic liquid. The working chamber 12 is delimited inter alia by a movable pulling piston 14 which is pressurized by the hydraulic liquid flowing in through the channel 11 and is moved thereby. When the push-button switch 4 is released and moved into the position illustrated in FIG. 1, the sliding valve 3 is switched and relieves the area below the pneumatic piston 7 so that the pulling piston 14 is returned to thereby displace the hydraulic liquid into the hydraulic cylinder 10.

In a manner known in the art, the air is displaced through a pipe 15 into the chamber above the pneumatic piston 7 and is then available at a later point in time for blowing out or vacuuming out a broken-off riveting drift.

The compressed air of connector 2 is also permanently available at the housing chamber 16 and flows from there via a channel 17 into a return chamber 18. Here a constant pressure is provided which matches the supply pressure of the blind riveting device 1.

Figure 2:
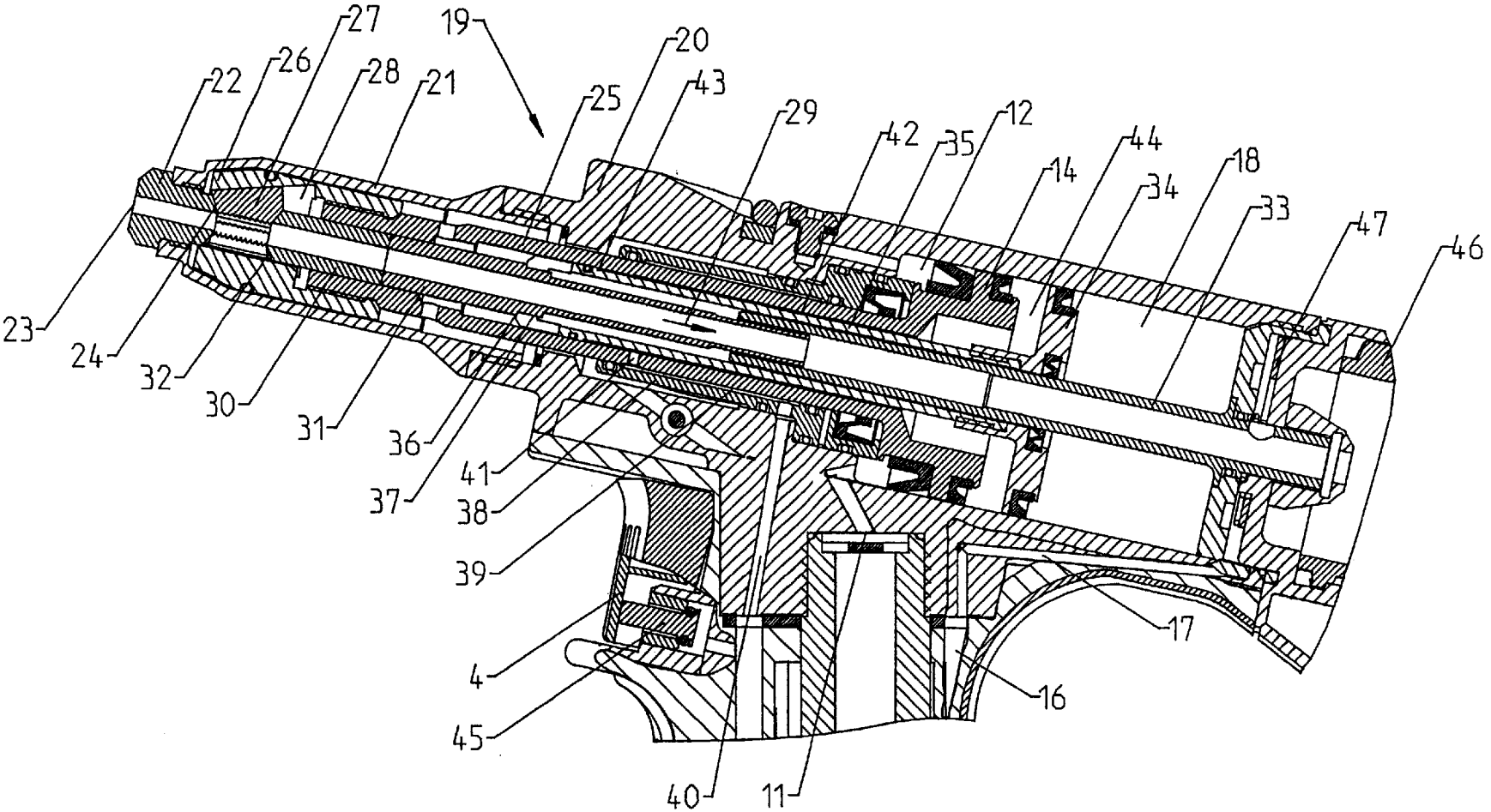
FIG. 2 is an enlarged representation of a portion of the blind riveting device.

FIG. 2 shows on a slightly enlarged scale the head 19 of the blind riveting device. This head 19 has a housing 20 into which a front part 21 with a mouth 22 is screwed. The mouth 22 has an opening 23 through which, in a manner known in the art, the riveting drift of a blind rivet (not shown) is introduced. The mouth 22 projects with a cone-shaped projection 24 slightly into the housing 20 or its front part 21.

In the device housing 20 a pulling device is arranged which, projecting from the pulling piston 14, comprises a connecting pipe 25. A chuck housing 26 is screwed onto the connecting pipe 25 at its front end where the chuck jaws 27 are arranged.

The chuck housing 26 has a groove 28 for each chuck jaw 27, and in the grooves the chuck jaws 27 can be moved parallel to the pulling direction illustrated by the arrow 29. The groove bottom of the groove 28 is substantially semi-circular in shape. The back of the chuck jaw 27 has a matching semi-circular rounded shape. In other respects, the walls of the groove 28 extend parallel to radial-beams so that the chuck jaws 27 are always guided in the groove 28, but at the same time, independent of their position parallel to the pulling direction 29, rest against the chuck housing 26 always with the same contact surface.

The chuck jaws 27 are forced by a pressure bushing in the direction toward the mouth 22, wherein the pressure bushing has a first bushing portion in the form of a front part 30 and a second bushing portion in the form of a rear part 31 which rest against one another. The front part 30 and the rear part 31 can be lifted off one another. However, when pressure is applied counter to the pulling direction 29 onto the rear part 31, the front part 30 is pressed against the chuck jaws 27. The front part 30 is formed as a simple tubular portion, i.e., it is a hollow cylinder. It has a conical front side 32 by which the chuck jaws 27 can be slightly spread apart when the chuck housing allows such a spreading movement. The chuck jaws 27 are correspondingly slanted in the opposite direction.

The rear part 31 projects into an ejector pipe 33 and is guided therein in a telescopic fashion. A return piston 34 is sealingly guided in the housing 20. The return piston 34 forms a movable boundary for the return chamber 18. It is loaded by pressure in the return chamber 18.

The return piston 34 is connected via a return pipe 35 with the rear part 31 wherein it is sufficient when this connection can transmit pressure forces. For this purpose, the rear part 31 has a circumferential projection 36 on which a reduced diameter portion 37 of the return pipe 35 rests. Of course, the return pipe 35 can also be screwed together with the rear part 31 of the pressure bushing. The connecting tube 25 is received in a support pipe 38 wherein between the connecting pipe 25 and the support pipe 38 a gap-shaped channel 39 remains by which a channel 40 is connected with an opening 41 in the connecting pipe 25. The opening 41, on the other hand, opens into an annular chamber 42 between the return pipe 35 and the connecting pipe 25. This annular chamber 42 is sealed in the forward direction by the return pipe 35 which for this purpose has an outer circumferential projection 43. To the rear, this annular chamber 42 opens into a pressure chamber 44 which is delimited by the pulling piston 14 and the return piston 34.

The blind riveting device 1 operates as follows:

In the rest or ready position illustrated in FIG. 2, the push-button switch 4 is not actuated and the valve 45 controlled by it is thus closed. In the return chamber 18 the pressure of the compressed air supply is present, for example, 6 bar. The same pressure reaches via the sliding valve 3 the channel 56, the channel 40, the channel 39, the opening 41, and the annular chamber 42 opening into the pressure chamber 44. The working chamber 12 is not loaded. The active pressure attack surface of the return piston 34 which delimits the pressure chamber 44 is smaller than the active surface which delimits the return chamber 18. This results from the return pipe 35 having a greater diameter than the ejector pipe 33. Accordingly, the return piston, for identical pressures, is pre-tensioned in the direction toward the mouth 22 and presses the chuck jaws 27 against the mouth 22, more precisely, against its projection 24. The force which acts in this connection onto the chuck jaws 27 results from the pressure difference between the two sides of the return piston 34.

The pressure in the pressure chamber 44 acts also on the pulling piston 14 and forces it also in the direction toward the mouth 22. Since the chuck jaws 27 cannot move farther, the chuck housing 26 is moved past the chuck jaws 27. This movement has the result that the chuck housing 26 frees the chuck jaws 27 and the chuck jaws 27 can open radially outwardly. In this state, a riveting drift of a blind rivet can be inserted easily through the opening 23.

The surfaces of the return piston 34 can be selected, for example, such that for a compressed air pressure of 6 bar a force of a magnitude of 600 N will act in the direction toward the mouth 22 will act while a force in the magnitude of 570 N will act in the opposite direction. Accordingly, only a force of 30 N will act on the mouth 22.

When a blind rivet is now inserted, the push-button switch 4 is actuated after insertion of the blind rivet into the mouth 22. It now vents the pressure chamber 44 via the annular chamber 42, the opening 41, and the channel 39 as well as the channel 40. Accordingly, the pressure in the pressure chamber 44 will collapse more or less suddenly. At the same time, via the sliding valve 3 the pneumatic piston 7 is loaded with pressure so that the hydraulic pressure, which is now quickly generated, reaches the working chamber 12 and moves the pulling system to the rear, i.e., to the right in FIG. 2.

On the return system 34 the forces caused by the pressure in the return chamber 18 act now on one side, in particular, in the direction toward the mouthpiece 22. In the described embodiment this is, for example, 600 N. With the 600 N the chuck jaws 27 are forced into the chuck housing 26. This force is significantly higher than a force that can be generated by most springs. A very high closing force results so that the riveting drift can be safely gripped by the chuck jaws 27. When because of the riveting drift a further inward movement of the chuck jaws 27 is no longer possible, the pulling piston 14 moves the riveting drift, secured in the chuck jaws 27, via the chuck housing 26 farther to the right so that the rivet head is formed and the riveting drift is broken off later on. In doing so, the pulling piston 14 must work against the pressure in the return chamber 18 wherein it transmits the corresponding forces via the chuck housing and the chuck jaws onto-the return piston 34. This pressure in the return chamber 18 is however comparatively minimal so that it does not interfere with the riveting process in a disruptive way.

When the riveting process is completed, which the operator can hear and feel as a result of the riveting drift breaking off, the operator will release the push-button switch 4. The hydraulic pressure in the working chamber 12 drops because the compressed air pressure under the pneumatic piston is lowered by the control valve 3 and the pneumatic piston 7 is returned together with the hydraulic piston 9 into the initial position. At the same time, the pressure in the pressure chamber 44 is built up. Since the pressure in the pressure chamber 44 is of the same magnitude as the pressure in the return chamber 18, but the surfaces of the return piston 34 are different, the pressure in the return chamber 18 moves the return piston 34 therefore in the direction toward the mouth 22 until the chuck jaws 27 rest on the mouth 22. The pressure in the pressure chamber 44 moves the chuck housing 26 slightly farther in the direction toward the mouth 22 so that the chuck jaws 27 come free and the riveting drift is released.

The now released riveting drift is then transported by means of a principally known vacuum removal device through the front part 30 and the rear part 31 as well as the ejector pipe 33 to a container 46, only schematically illustrated, which is fastened to the rear on the head 19. This container 46 has two tasks. On the one hand, it collects the broken-off riveting drifts; on the other hand, it prevents that the riveting drifts will shoot freely out of the device during ejection from the head.

Figure 4:
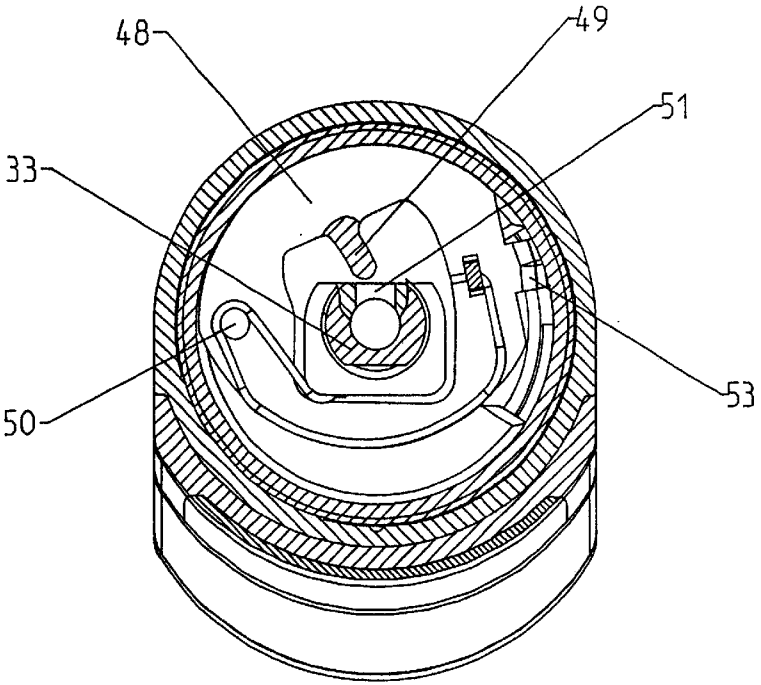
FIG. 4 is a schematic illustration of the lock in the open state.
Figure 3:
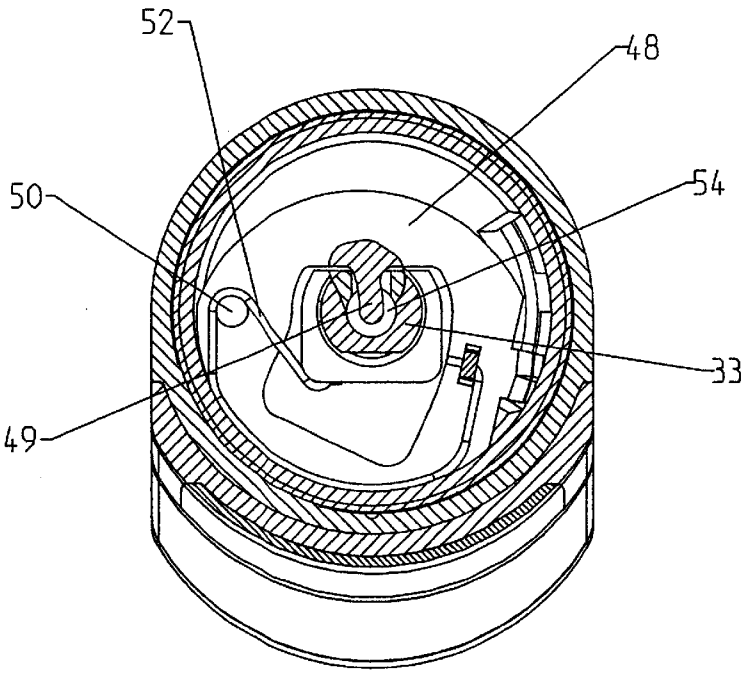
FIG. 3 is a schematic illustration of a lock in the closed state.

In order to prevent that such a danger is present when the container 46 is removed, a lock 47 is provided, which is illustrated in more detail in FIGS. 3 and 4. The lock 47 cooperates with the ejector pipe 33. The lock 47 comprises a plate 48 with a finger 49 wherein the plate 48 is pivotable about the pivot point 50. The pivot axis of the plate 48 is parallel to the axis of the ejector pipe 33. The ejector pipe 33 has an opening 51 through which the finger 49 can be introduced. A spring 52 secures the plate 48 in the position illustrated in FIG. 3 when the container 46 is not mounted. The container 46 can be connected by means of a bayonet closure to the head, for example, a rotation by approximately 45° is sufficient for fastening. As this rotation is carried out, the container engages of projection 53 on the plate 48 and moves it into the position illustrated in FIG. 4.

In the position illustrated in FIG. 3 the finger 49 does not close completely the free cross-section of the ejector pipe 33. A gap 54 remains instead which is selected to be so large that the air required for removing the riveting drifts can flow out freely, so that no pressure is built up in the ejector pipe 33, but to be so small that the broken-off riveting drifts cannot pass the finger 49.

This lock can also be used independent of the described configuration of the pulling device.

While specific embodiments of the invention have been shown and described in detail to illustrate the inventive principles, it will be understood that the invention may be embodied otherwise without departing from such principles.

What is claimed is:

1. A pneumatic-hydraulic blind riveting device comprising:

a device housing;

a pulling device arranged in the device housing;

the pulling device comprising a chuck housing and chuck jaws arranged in the chuck housing;

the pulling device comprising a pulling piston connected to the chuck housing and further comprising a return piston;

the pulling device comprising a pressure bushing arrangement resting against the chuck jaws and interacting with the return piston, wherein a pressure chamber is defined between the return piston and the pulling piston;

a control device configured to load the pressure chamber with a controlled pressure.

2. The blind riveting device according to claim 1, wherein the pressure bushing arrangement is rigid in a pressure loading direction between the return piston and the chuck jaws.

3. The blind riveting device according to claim 1, wherein the pressure bushing arrangement comprises a pressure bushing divided transversely relative to a longitudinal direction of the pressure bushing into a first bushing portion and a second bushing portion, wherein the first bushing portion rests against the chuck jaws and is a hollow cylinder having a smooth mantle surface.

4. The blind riveting device according to claim 1, wherein the control device is configured to lower the pressure in the pressure chamber when loading the pulling piston in a pulling direction with hydraulic pressure.

5. The blind riveting device according to claim 1, wherein the return piston has a first end facing the pulling piston and a second end facing away from the pulling piston, wherein the second end has an active surface that is greater than an active surface of the first end and wherein the first and second ends are configured to be loaded with the same pressure.

6. The blind riveting device according to claim 5, wherein the return piston has a return pipe and the pulling piston has a connecting pipe, wherein the return pipe projects into the connecting pipe.

7. The blind riveting device according to claim 1, wherein the second end of the pulling piston is configured to be loaded with a constant pressure.

8. The blind riveting device according to claim 1, further comprising an ejector pipe, wherein the return piston is guided on the ejector pipe.

9. The blind riveting device according to claim 8, further comprising a drift collecting container, wherein the ejector pipe comprises a lock configured to be actuated by the drift collecting container, wherein the lock has a locking surface matched to a cross-section of the ejector pipe so that a gap remains having a size allowing flow of air but preventing drifts from passing through.

10. The blind riveting device according to claim 9, wherein the lock is formed by a plate and a finger connected to the plate, wherein the plate is pivotable about an axis extending parallel to an axis of the ejector pipe.

11. The blind riveting device according to claim 10, wherein the finger is configured to be radially inserted into the ejector pipe.

12. The blind riveting device according to claim 1, wherein the chuck housing has grooves and wherein the chuck jaws are guided in the grooves, wherein the grooves have a groove bottom having a constant cross-section across a predetermined length, and wherein the chuck jaws have a cross-section matching the constant cross-section of the groove bottom.

* * * * *